US007127991B2

(12) United States Patent
Hoffmann et al.

(10) Patent No.: US 7,127,991 B2
(45) Date of Patent: Oct. 31, 2006

(54) METHOD AND PRINTING UNIT FOR INFLUENCING LATERAL WEB SPREADING IN PARTICULAR IN ROTARY PRESSES

(75) Inventors: Eduard Hoffmann, Bobingen (DE); Christian Sameit, Augsburg (DE); Georg Schmid, Neusäss (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 127 days.

(21) Appl. No.: 10/911,310

(22) Filed: Aug. 4, 2004

(65) Prior Publication Data

US 2005/0056171 A1 Mar. 17, 2005

(30) Foreign Application Priority Data

Aug. 5, 2003 (DE) ..... 103 35 758

(51) Int. Cl.
*B41F 5/00* (2006.01)
*B41F 3/00* (2006.01)

(52) U.S. Cl. ..... 101/216; 101/183; 101/217; 101/275; 101/276; 101/375

(58) Field of Classification Search ..... 101/216, 101/217, 376, 275, 276, 183
See application file for complete search history.

(56) References Cited

U.S. PATENT DOCUMENTS

| | | | | |
|---|---|---|---|---|
| 2,762,295 A | | 9/1956 | Varga et al. | |
| 3,065,690 A | | 11/1962 | Heller et al. | |
| 3,366,047 A | | 1/1968 | Brabec et al. | |
| 3,785,287 A | * | 1/1974 | Dahlgren | 101/247 |
| 4,214,527 A | | 7/1980 | Kamota | |
| 4,332,194 A | * | 6/1982 | Gensheimer | 101/216 |
| 4,365,552 A | | 12/1982 | Kubert | |
| 4,372,205 A | * | 2/1983 | Pflaum | 101/153 |
| 4,458,591 A | | 7/1984 | Guaraldi | |
| 4,487,122 A | * | 12/1984 | George et al. | 101/153 |
| 4,748,909 A | | 6/1988 | Theilacker | |
| 5,285,726 A | * | 2/1994 | Ohta | 101/228 |
| 5,301,609 A | | 4/1994 | Guaraldi et al. | |
| 5,863,367 A | * | 1/1999 | Behnke et al. | 156/154 |
| 6,105,498 A | | 8/2000 | Vrotacoe | |
| 6,283,027 B1 | | 9/2001 | Vrotacoe | |
| 6,524,227 B1 | * | 2/2003 | Isometsa et al. | 492/7 |
| 6,860,200 B1 | * | 3/2005 | Knauer et al. | 101/220 |

FOREIGN PATENT DOCUMENTS

| | | |
|---|---|---|
| CH | 477978 | 9/1969 |
| DE | 21 42 902 | 3/1973 |

(Continued)

*Primary Examiner*—Andrew H. Hirshfeld
*Assistant Examiner*—Marvin P. Crenshaw
(74) *Attorney, Agent, or Firm*—Cohen, Pontani, Lieberman & Pavane

(57) ABSTRACT

A printing unit for influencing lateral web spreading in particular in rotary presses, which makes constant contact conditions possible across the width in the rubber-rubber nip and improves the lateral-register quality and the web run without using concave or convex blanket cylinders, has a blanket cylinder and plate cylinders which can be set against the former for printing on one or both sides of a web. The web passes through between the blanket cylinders in a contact zone, it either being possible to skew at least one of the blanket cylinders with respect to the respective plate cylinder or it being possible to skew at least one of the plate cylinders with respect to the respective blanket cylinder, for producing a concave velocity profile on the web.

12 Claims, 2 Drawing Sheets

FOREIGN PATENT DOCUMENTS

| | | |
|---|---|---|
| DE | 27 04 813 A1 | 8/1978 |
| DE | 44 02 389 A1 | 9/1994 |
| DE | 42 44 787 A1 | 2/1995 |
| DE | 44 36 973 A1 | 6/1995 |
| DE | 44 20 355 C2 | 12/1995 |
| GB | 21473 | 9/1912 |
| WO | WO 03/016184 | 2/2003 |

* cited by examiner

METHOD AND PRINTING UNIT FOR INFLUENCING LATERAL WEB SPREADING IN PARTICULAR IN ROTARY PRESSES

BACKGROUND OF THE INVENTION

1. Field of the Invention

The invention relates to a method and a printing unit for influencing lateral web spreading in rotary presses.

2. Description of the Related Art

When two cylinders of a rotary press are rolling on one another, line loads or else individual bending forces which cause the cylinders to deflect between their two bearings on the machine frame act on the cylinders along the common line of contact perpendicular to the axes of rotation of the cylinders. This has a disadvantageous effect on the paper-web run and the printing result. In slim cylinders having small diameters and great web widths, web-run problems in the form of wave or fold formation occur in the rubber-rubber nip on account of non-constant contact conditions across the width. In particular, the abovementioned web-run problems occur when the paper web is moved here with an irregular velocity profile because of the previously described positional change or non-constant contact conditions across the width, the center of the paper web being moved more quickly than the outer side of the web, which leads to fold formation. However, the web-transport behavior in web-fed offset presses is influenced critically by the conveying characteristics of the rubber blankets. In particular in printing presses having a slim cylinder geometry, fold formation can occur across the web width, which folds have a negative influence on the lateral-register quality.

To eliminate this problem, rubber-blanket sleeves have already been configured with a variable surface geometry across the web width, for example in U.S. Pat. No. 6,283,027, that is to say a thickness profile varied by the circumferential surface assuming a shape in the axial direction of the cylinder which reduces deflection of the blanket cylinder.

SUMMARY OF THE INVENTION

It is an object of the present invention to provide a rotary press having optimized lateral web spreading which makes constant contact conditions possible across the width in the rubber-rubber nip between blanket cylinders and improves the lateral-register quality and the web run without using rubber-blanket sleeves or rubber blankets whose geometrical or material properties are varied across the web width.

The object is achieved according to the present invention by a printing unit for rotary presses for influencing lateral web spreading, the respective printing unit having blanket cylinders and plate cylinders which can be set against the blanket cylinder, with which it is possible to print a web on one and/or both sides, the web passing through between the blanket cylinders in a contact zone, wherein at least one of the blanket cylinders can be skewed with respect to the respective plate cylinder or at least one of the plate cylinders can be skewed with respect to the respective blanket cylinder in the contact zone X. As a result, the pressure in the central region of the contact zone (X) is increased, so that, in the contact zone (X), the effective radius of at least one rubber blanket clamped on the blanket cylinders increases from the center outwards and the velocity at the outer sides of the web passing through between the blanket cylinders is increased compared with the center, it being possible to produce a concave velocity profile.

The contact conditions in the rubber-rubber nip are adapted to the requirements by a variable elastic line of one blanket cylinder or both blanket cylinders. The bending can be introduced (counterflexing) into the cylinder or cylinders by additional, displaceable cylinder bearings, as a result of which the pressure in the central region of the contact zone (rubber-rubber nip) is increased, so that, in the contact zone, the effective radius of a rubber blanket attached to the respective blanket cylinder increases from the center outwards and the velocity at the outer sides of the web passing through between the blanket cylinders is increased compared with the center, a concave velocity profile being produced without using rubber-blanket sleeves or rubber blankets whose geometrical or material properties are varied across the web width.

Instead of counterflexing the blanket cylinder or the plate cylinder which can be set against a blanket cylinder, either at least one blanket cylinder may be arranged in a manner skewed with respect to the plate cylinder which can be set against it or at least one plate cylinder may be arranged in a manner skewed with respect to its blanket cylinder. The result of this arrangement is that the supporting action of the plate cylinder is increased in the web center and consequently the pressure in the central region of the contact zone (rubber-rubber nip) is increased, so that, in the contact zone, the effective radius of at least one rubber blanket clamped on the blanket cylinders increases from the center outwards and the velocity at the outer sides of the web passing through between the blanket cylinders is increased compared with the center, it being possible to produce a concave velocity profile without using rubber-blanket sleeves or rubber blankets whose geometrical or material properties are varied across the web width.

It is significant that the contact conditions between the individual cylinders can be adapted to the requirements of the printing material while the machine is running.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
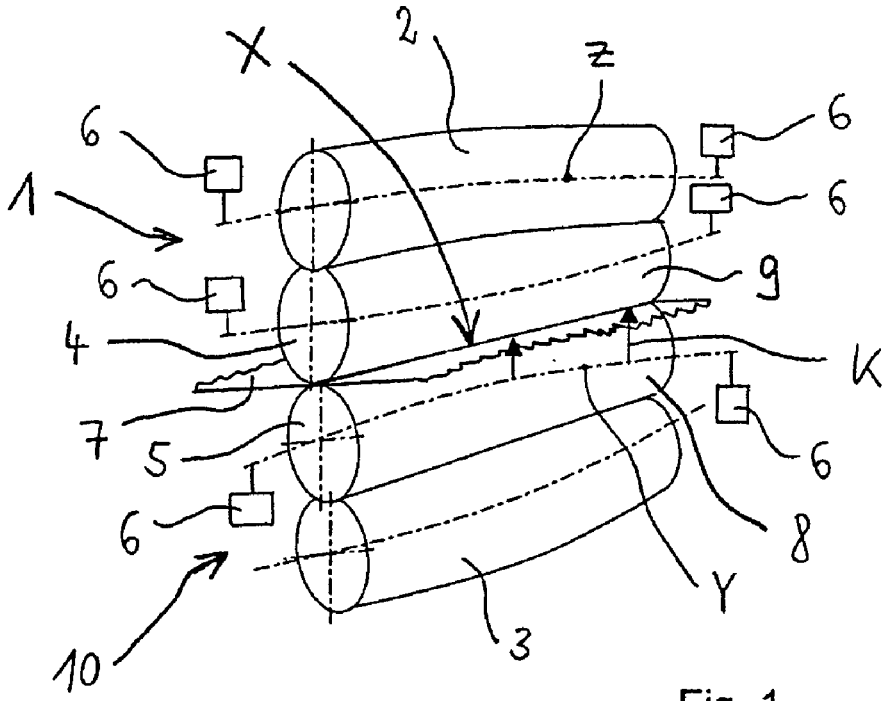
FIG. 1 is a perspective schematic view of part of a printing unit having counterflexed blanket cylinders.

FIG. 1 shows a part of a printing unit having respective printing units 1, 10 comprising a plate cylinder 2, 3 and a blanket cylinder 4, 5 which (in a manner not shown in greater detail) are all mounted parallel to one another on both sides in a respective side wall. The blanket cylinders 4, 5 have a uniform cylindrical surface geometry across the web width in the uninstalled state and are equipped with a bending apparatus 6 for influencing a bending profile thereon, preferably for reducing a deflection Y of the blanket cylinder 4, 5. Plate-shaped or sleeve-shaped rubber blankets 8, 9 which have a uniform cylindrical surface geometry are clamped to the blanket cylinders 4, 5.

The apparatus 6 for influencing the bending profile of a blanket cylinder of a rotary press is described in greater detail, for example, in DE 44 20 355 C2.

A web 7 is led through between the blanket cylinders 4, 5 in a contact zone X, it being possible to print the web 7 on one and/or both sides.

Figure 3:
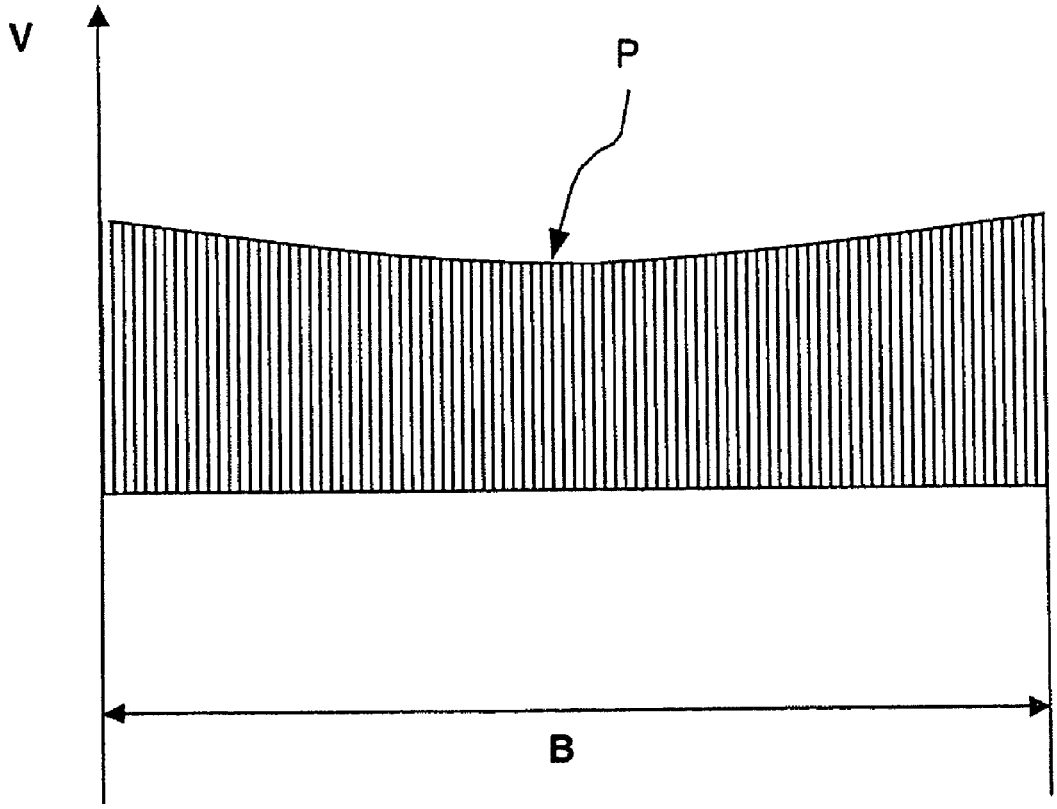
FIG. 3 is a graph showing a concave velocity profile.

As an alternative, at least one plate cylinder 2, 3 may be configured with the bending apparatus 6 for influencing the bending profile. A bending moment is applied to the plate cylinder 2, 3 counter to the direction of the deflection Z of the said plate cylinder 2, 3, so that the deflection Y of the blanket cylinder 4, 5 interacting with the said plate cylinder 2, 3 is reduced, the bending moment being caused by a variable force K applied to the cylinder axle of the plate cylinder 2, 3 by the bending apparatus 6. As a result of which the pressure in the central region of the contact zone X is increased, so that, in the contact zone X, the effective radius of at least one rubber blanket 8, 9 clamped on the blanket cylinders 4, 5 increases from the center outwards and the velocity V at the outer sides of the web 7 passing through between the blanket cylinders 4, 5 is increased compared with the center, so that a concave velocity profile P is produced across the web width B of the web 7 (the concave velocity profile is shown in FIG. 3).

Figure 2:
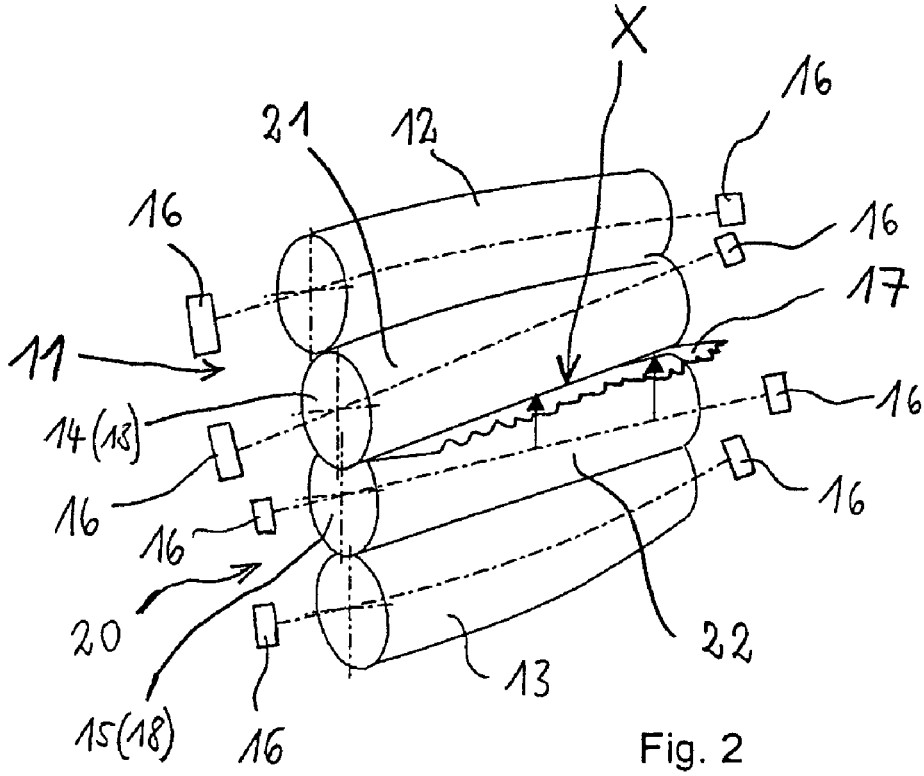
FIG. 2 is a perspective schematic view of a part of a printing unit having cylinders arranged in a manner crossed with respect to one another.

FIG. 2 shows a part of a printing unit having respective printing units 11, 20 comprising a plate cylinder 12, 13 and a blanket cylinder 14, 15 which (in a manner not shown in greater detail) are all mounted on both sides in a respective side wall. The plate cylinders 12, 13 are arranged in a manner skewed with respect to the respective blanket cylinder 14, 15, the respective cylinder surfaces touching one another. The blanket cylinders 14, 15 are arranged parallel to one another. Plate-shaped or sleeve-shaped rubber blankets 21, 22 which have a uniform cylindrical surface geometry are clamped onto the blanket cylinders 14, 15. The plate cylinders 12, 13 are equipped with an adjusting unit 16 in order to perform the skewing movement. The skewing of the plate cylinders 12, 13 can be adjusted by the adjusting units 16 with the machine running or stationary, it being possible to configure the adjusting units 16 with motors.

Increased pressure is brought about in the central region of the contact zone X by the skewing of at least one plate cylinder 12, 13 with respect to the respective blanket cylinder 14, 15, so that, in the contact zone X, the effective radius of at least one rubber blanket 21, 22 clamped on the blanket cylinders 14, 15 increases from the center outwards and the velocity V at the outer sides of the web 17 passing through between the blanket cylinders 14, 15 is increased compared with the center, so that a concave velocity profile P (see FIG. 3) is produced across the web width B.

The skewing of a cylinder, in particular of a plate cylinder for diagonal adjustment, is known from the text book "Der Rollenoffsetdruck" [Web-fed Offset Printing] by Wolfgang Walenski, page 246 et seq., 1st Edition 1995, Fachschriften Verlag.

A web 17 is led through between the blanket cylinders 14, 15 in a contact zone X, it being possible to print the web 17 on one and/or both sides.

As an alternative, the plate cylinders 12, 13 may be arranged parallel to one another, it being possible to cross the blanket cylinders 14, 15. The blanket cylinders 14, 15 are arranged in a manner skewed with respect to the respective plate cylinder 12, 13, the respective cylinder surfaces touching one another. The blanket cylinders 14, 15 may be arranged skewed relative to each other in such a way that the longitudinal axes thereof cross over one another. The blanket cylinders 14, 15 are equipped with the adjusting unit 16 in order to perform the skewing movement. The skewing of the blanket cylinders 14, 15 can be adjusted by means of the adjusting units 16 with the machine running or stationary.

Increased pressure is brought about in the central region of the contact zone X by the skewing of at least one blanket cylinder 14, 15 with respect to the respective plate cylinder 12, 13, so that, in the contact zone X, the effective radius of at least one rubber blanket 21, 22 clamped on the blanket cylinders 14, 15 increases from the center outwards and the velocity V at the outer sides of the web 17 passing through between the blanket cylinders 14, 15 is increased compared with the center, so that a concave velocity profile P (see FIG. 3) is produced across the web width B.

As an alternative, the blanket cylinders 4, 5, 14, 15 may be configured as impression cylinders 18, the respective plate cylinder 2, 3, 12, 13 paired with the blanket cylinder 4, 5, 14, 15 which is now configured as an impression cylinder 18 being omitted.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing unit for influencing lateral web spreading in a rotary printing press, the printing unit comprising:

first and second transfer cylinders contacting each other along a contact zone and arranged for receiving a web to be printed on therebetween, at least one plate cylinder respectively settable onto one of said first and second transfer cylinders for printing on at least one side of the web receivable between said first and second transfer cylinders in the contact zone, and at least one rubber blanket clamped onto one of said first and second transfer cylinders, wherein said one of said first and second transfer cylinders is movable to a skewed position relative to the at least one plate cylinder so that a pressure in a center region of the contact zone along a length of the contact zone is increased, thereby increasing the effective radius of the at least one rubber blanket from the center region of the contact zone outward so that a concave velocity profile is producible on the web receivable in the contact zone between said first and second transfer cylinders, the velocity at the outer sides of the concave velocity profile being greater than the velocity at the center of the velocity profile.

2. The printing unit of claim 1, wherein said first and second transfer cylinders are skewed so that longitudinal axis thereof traverse one another.

3. The printing unit of claim 1, further comprising a motorized adjusting unit for adjusting the skewed position of said one of said first and second transfer cylinders.

4. The printing unit of claim 1, further comprising at least one of rubber-blanket sleeves and rubber blankets arranged on each of circumferential surfaces of said first and second transfer cylinders.

5. The printing unit of claim 1, further comprising first and second plate cylinders settable on said first and second transfer cylinders, and at least one of printing-form sleeves and printing plates arranged on each of circumferential surfaces of said first and second plate cylinders.

6. The printing unit of claim 1, wherein one of said first and second transfer cylinders is configured as an impression cylinder.

7. A printing unit for influencing lateral web spreading in a rotary printing press, the printing unit comprising:

first and second transfer cylinders contacting each other along in a contact zone and arranged for receiving a web to be printed on therebetween, at least one plate cylinder respectively settable onto one of said first and second transfer cylinders for printing on at least one side of the web receivable between said first and second transfer cylinders in the contact zone, and at least one rubber blanket clamped onto one of said first and second transfer cylinders, wherein said at least one plate cylinder is skewable with respect to the respective one of said first and second transfer cylinders so that a pressure in a center region of the contact zone along a length of the contact zone is increased, thereby increasing the effective radius of the at least one rubber blanket from the center region of the contact zone outward so that a concave velocity profile is producible on the web receivable in the contact zone between said first and second transfer cylinders, the velocity at the outer sides of the concave velocity profile being greater than the velocity at the center of the velocity profile.

8. The printing unit of claim 7, wherein said first and second transfer cylinders are skewed so that the longitudinal axes thereof traverse one another.

9. The printing unit of claim 7, further comprising a motorized adjusting unit for adjusting the skewed position of said at least one plate cylinder.

10. The printing unit of claim 7, further comprising at least one of rubber-blanket sleeves and rubber blankets arranged on each of circumferential surfaces of said first and second transfer cylinders.

11. The printing unit of claim 7, wherein said at least one plate cylinder includes first and second plate cylinders respectively settable onto said first and second transfer cylinders, said printing unit further comprising at least one of printing-form sleeves and printing plates arranged on each of circumferential surfaces of said first and second plate cylinders.

12. The printing unit of claim 7, wherein one of said first and second transfer cylinders is configured as an impression cylinder.

* * * * *